US006788799B1

(12) United States Patent
Ishigaki et al.

(10) Patent No.: US 6,788,799 B1
(45) Date of Patent: Sep. 7, 2004

(54) SPEAKER DEVICE AND ASSOCIATED METHOD FOR MANUFACTURING THE SPEAKER DEVICE

(75) Inventors: Toshihiro Ishigaki, Tendo (JP); Yasuhisa Abe, Tendo (JP); Yoshitaka Kobayashi, Tendo (JP)

(73) Assignees: Pioneer Electronic Corporation, Tokyo (JP); Tohoku Pioneer Electronic Corporation, Yamagata (JP)

( * ) Notice: Subject to any disclaimer, the term of this patent is extended or adjusted under 35 U.S.C. 154(b) by 0 days.

(21) Appl. No.: 09/450,559

(22) Filed: Nov. 30, 1999

(30) Foreign Application Priority Data

Dec. 4, 1998 (JP) ..... 10-361921

(51) Int. Cl.[7] ..... H04R 25/00

(52) U.S. Cl. ..... 381/397; 381/400; 381/407; 381/412

(58) Field of Search ..... 381/397, 400, 381/403, 404, 405, 407, 408, 410, 409, 412, 415; 29/594, 609.1

(56) References Cited

U.S. PATENT DOCUMENTS

| | | | | | |
|---|---|---|---|---|---|
| 1,971,452 | A | * | 8/1934 | Herrmann | 381/400 |
| 4,303,806 | A | * | 12/1981 | Thiele | 381/410 |
| 5,430,804 | A | * | 7/1995 | Wijnker | 381/410 |
| 5,647,014 | A | * | 7/1997 | Geisenberger | 381/400 |
| 6,111,969 | A | * | 8/2000 | Babb | 381/407 |

* cited by examiner

*Primary Examiner*—Curtis Kuntz
*Assistant Examiner*—Suhan Ni
(74) *Attorney, Agent, or Firm*—Morgan, Lewis & Bockius LLP

(57) ABSTRACT

A speaker device and associated method for producing a speaker device that includes a voice coil and a radiant layer made of a radiant energy emissive material provided on a surface of the voice coil for suppressing the heat generated at the voice coil while simultaneously improving the input durability of the speaker device.

7 Claims, 4 Drawing Sheets

SPEAKER DEVICE AND ASSOCIATED METHOD FOR MANUFACTURING THE SPEAKER DEVICE

This application claims the benefit of Japanese Patent Application No. 10-361921, filed Dec. 4, 1998, which is hereby incorporated by reference.

BACKGROUND OF THE INVENTION

1. Field of the Invention

This invention relates to speaker devices, and more particularly, to speaker devices for conversion of electrical signals into corresponding acoustic energies and the associated method for manufacturing such speaker devices.

2. Discussion of the Related Art

FIG. 6 illustrates the arrangement of an electrically-driven cone-shaped speaker of the conventional art. This traditional cone-shaped speaker unit of FIG. 6 is designed to include, for example, a vibrator plate 1, formed of part of a nearly conical shape, and a cylindrical voice coil bobbin 3 with a voice coil 2 wound there around as laid out at the center of the vibrator plate 1 in a manner such that these elements are integral with the vibrator plate 1.

The vibrator plate 1 and voice coil bobbin 3 are rigidly attached to a ring-shaped edge portion 8, having appropriate compliance and stiffness, and also to one terminate end of a dumper 9. Moreover, the edge portion 8 and a remaining end of the dumper 9 are fixed to a frame 12 that is integrally formed with a magnetic circuit 7 thereby attaining elastic support of the vibrator plate 1 and voice coil bobbin 3 together.

With such an arrangement, the edge portion 8 and dumper 9 serve to dispose the voice coil 2 and voice coil bobbin 3 within a magnetic gap of the magnetic circuit 7 that consists essentially of a magnet 4, a plate 5, and a pole yoke 6, for example, in such a mariner that the voice coil 2 and bobbin 3 are not in physical contact with the magnetic circuit 7. The vibrator plate 1 is situated to be elastically supported so that it offers reciprocal piston-like vibrating abilities within a predefined vibration range in a specified direction.

In addition, both ends of the voice coil 2 are connected to selected ends of a pair of conductive lead wires 11 respectively, the remaining ends of which are connected to a pair of terminals 10 as provided at the frame 12, respectively.

This arrangement results in the voice coil 2 operating responsively to the receipt of electrical drive power as supplied thereto from the terminals 10 via the conductive lead wires 11 for producing magnetic flux. The voice coil 2 is thus driven within the magnetic gap of the magnetic circuit 7 in a direction along the piston vibration direction of the vibrator plate 1. The vibrator plate 1 vibrates in a manner that is integral with the voice coil 2 and voice coil bobbin 3 to convert electrical signals into corresponding acoustic energies for external radiation of resultant sound waves.

The arrangement of related art results in several inherent problems. For example, the voice coil 2 increases in temperature with an increase in drive power due to the fact that the electrical energy input to the voice coil 2 will possibly be converted not only to the externally radiated acoustic energy stated above, but also to energy consumed by resistance components of the voice coil 2 and the like. This temperature increase results in the occurrence of various damages of coatings and distortion due to thermal expansion of the voice coil 2 as well as unwanted breakdown, or open-circuiting, of lead wires used. This in turn leads to an eventual destruction of the speaker unit.

Because the cylindrically-shaped voice coil 2 of the related art is arranged so that the magnetic circuit 7 surrounds the periphery of the coil 2 in a manner such that the magnetic circuit 7 spatially sandwiches it at both surfaces thereof with a predetermined narrow gap retained therebetween, heat generated from the voice coil 2 must be released toward the outside in order to reduce temperature within the speaker arrangement based on a flow of the air residing in this narrow gap, carrying the heat as shown in FIG. 7. The heated air then attempts to move or "drift" due to vibrations at the voice coil 2 and also heat conduction toward the magnetic circuit 7. This results in an eventual cooling of the voice coil 2 to reduce its temperature. However, such a heat release/radiation scheme utilizing air as a heat-carrying medium remains lower in efficiency of conduction of heat of the voice coil 2 so that the drive power will be likewise lowered in critical level leading to eventual destruction of the speaker. This simultaneously limits or restricts the input durability of the speaker per se. In view of these problems, a key to effective speaker design lies in the minimization of voice coil 2 temperature increases due to drive power while at the same time maximizing the input durability of the speaker itself.

One prior art attempt to remedy the temperature increase problem discussed above is to employ specific structural members made of thermal-resistant materials and/or to redesign the speaker device structure. These prior approaches nevertheless do not attain the intended effects of solving the above-described problems.

SUMMARY OF THE INVENTION

Accordingly, the present invention is directed to a speaker device that substantially obviates one or more of the problems due to limitations and disadvantages of the related art.

An object of the present invention is the provision of a speaker device that results in a improved flow of heat generated within the speaker device to the outside of the speaker device.

Another object of the present invention is to improve the cooling effects of the speaker device and increasing the heat release efficiency of the voice coil within the speaker device to thereby enhance the input durability of the speaker device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the speaker device includes an voice coil having a thermal radiator layer provided on a surface of the voice coil. This thermal radiator layer is made of a chosen heat-releasable material for use in emitting radiant energy including infrared rays.

In another aspect of the instant invention, the speaker device includes a voice coil and a radiant layer made of a radiant energy emissive material provided on a surface of the voice coil.

In a further aspect of the instant invention, a method of manufacturing a speaker device comprises the steps of providing a voice coil within the speaker device; forming a radiant layer from a radiant energy emissive material; and providing the radiant layer on a surface of the voice coil.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
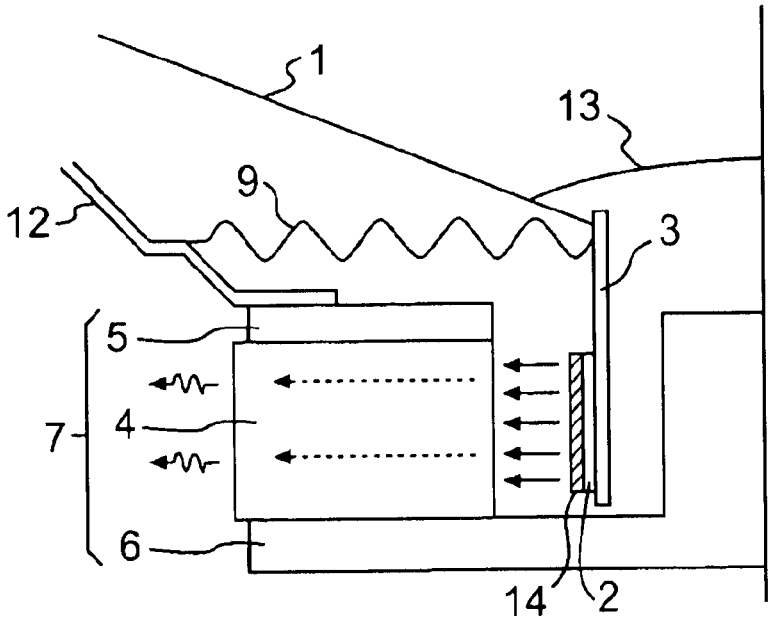
FIG. 1 illustrates a first embodiment of the speaker device of the present invention including a voice coil with a radiant layer formed thereon along with its associative components disposed near or around the voice coil.
Figure 2:
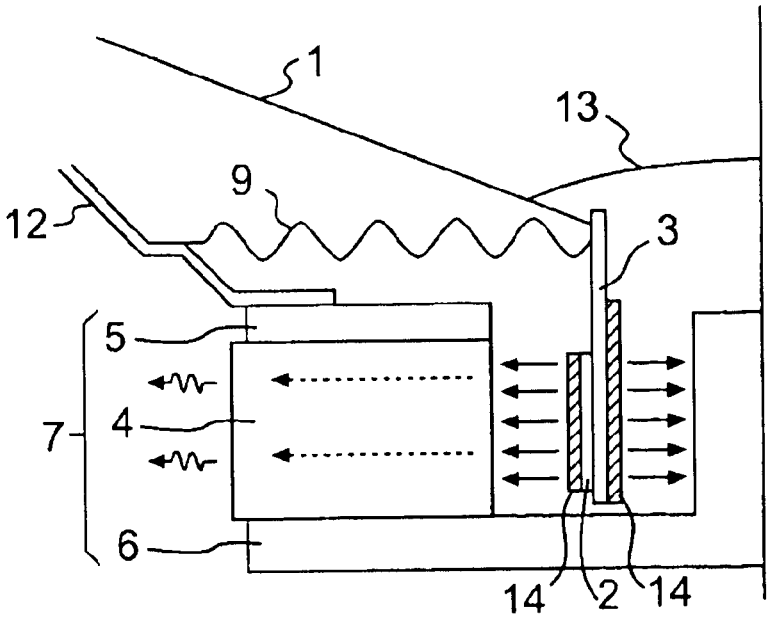
FIG. 2 illustrates a second embodiment of this invention including a voice coil and voice coil bobbin with radiant layers formed thereon along with associative components disposed adjacent thereto.
Figure 3:
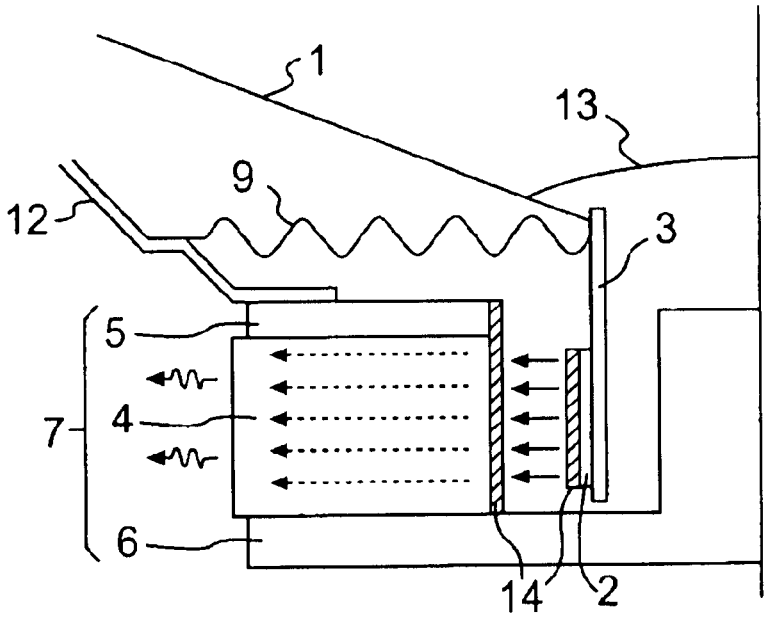
FIG. 3 illustrates a third embodiment of the invention including a voice coil received within a gap of magnetic circuitry with radiant layers formed both on the coil as well as on an inner surface of the gap, along with associative components disposed adjacent thereto.
Figure 4:
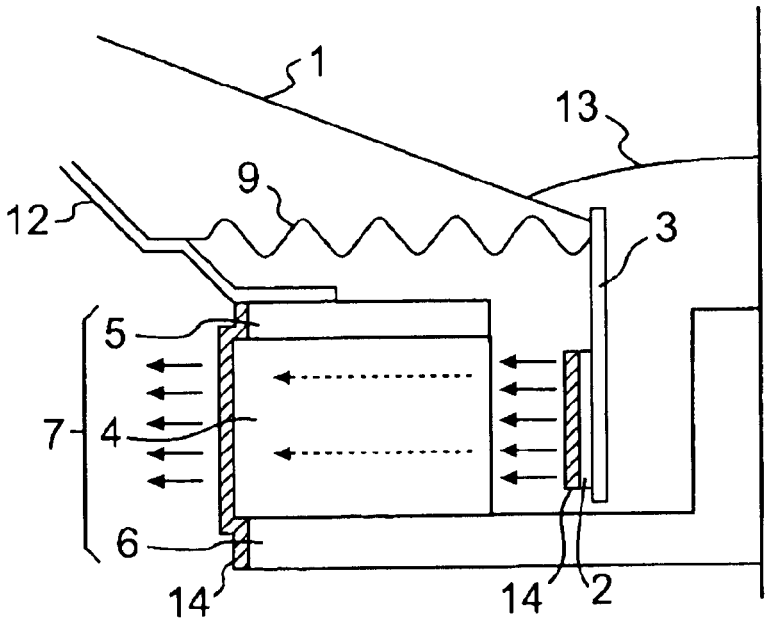
FIG. 4 illustrates a fourth embodiment of the invention including a voice coil received in a gap of magnetic circuitry with radiant layers formed on both the coil as well as on an outer surface of the magnetic circuit, along with components disposed adjacent thereto.
Figure 5:
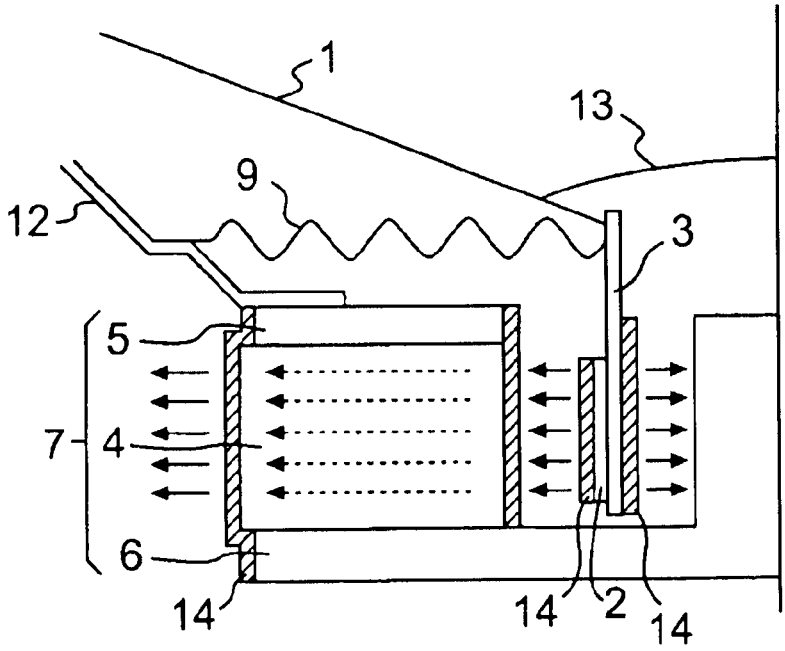
FIG. 5 illustrates a fifth embodiment of the invention including a voice coil received in a gap of magnetic circuitry with radiant layers formed on the coil, on the gap's inner surface, as well as on the magnetic circuitry's outer surface, along with components disposed adjacent thereto.
Figure 6:
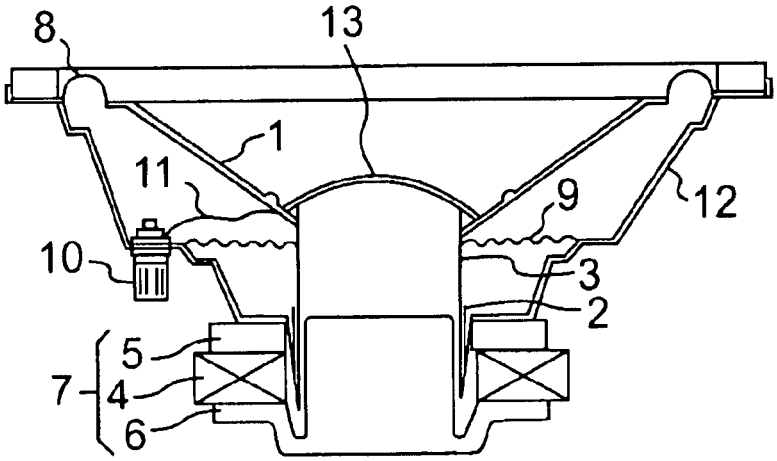
FIG. 6 illustrates an exemplary related art electrically-driven cone-shaped speaker unit.

FIG. 1 is a diagram depicting a speaker structure having a radiant layer 14 that emits heat by radiation, which is formed on the surface of a voice coil 2. FIG. 2 illustrates a speaker module having an additional radiant layer 14 formed on the surface of a voice coil bobbin 3 in addition to the radiant layer 14 of FIG. 1. FIG. 3 depicts a speaker with an additional radiant layer 14 formed on an inner surface of a gap of a magnetic circuit 7 in addition to the radiant layer 14 of FIG. 1. FIG. 4 shows a speaker with a radiant layer 14 formed on an outer surface of the magnetic circuit 7 in addition to the radiant layer of FIG. 1. FIG. 5 shows a speaker with radiant layers 14 formed on the inner and outer surfaces of the gap of magnetic circuit 7, and an additional radiant layer 14 formed on the surface of the voice coil bobbin 3, in addition to the layer of FIG. 1. In FIGS. 1 to 5 and 7, straight line arrows designate directions of heat conduction by infrared rays. In these same drawings, waved arrows denote heat conduction due to an air flow. Arrows shown by dotted lines in these drawings are used to indicate heat conduction inside of an object involved.

One example of the radiant material used in the speaker device of the instant invention will first be explained prior to explaining the electrically-driven speaker units in accordance with several preferred embodiments of the invention shown in FIGS. 1 through 5. The term "radiant material" as used herein may refer to certain coating materials each containing therein as its principal component a ceramics-based material high in radiation coefficient or emissivity, which are coated or "painted" on surfaces of an object to form thereon a high radiant layer for improvement of the resultant emissivity on the object surfaces. The nature of these materials is such that high emissivity materials are excellent in efficiency of converting heat to corresponding infrared rays for external heat release by radiation and also good in heat absorbability through infrared radiation-to-heat conversion.

It is noted that thermal or heat radiation is different in meaning from heat conduction in that whereas the former is drawn to direct conduction of thermal energy between molecules in materials, the latter is thermal energy conduction through conversion into electromagnetic waves (infrared light or else) without requiring any intermediate materials concerned.

An explanation will next be given of the heat radiation effect of a radiant material by using an example thereof. When an object of interest that is coated with this radiant material on its surface increases in temperature, thermal energy is transferred by heat conduction mechanisms to the radiant material on the object surface. Thereafter, this temperature-increased radiant material externally radiates or releases heat as obtained from the object after having converted it to corresponding infrared rays at its inherently high emissivity. Through this activity, the object exhibits external heat release due to heat radiation that is higher in efficiency than the emissivity of itself to thereby significantly increase the radiational cooling effects. This in turn makes it possible to improve the thermal durability of the object per se.

Upon the receiving of infrared light by the radiant material as coated on the surface of the object, the temperature of such radiant material increases due to the fact that this material converts the infrared light into heat at its inherently high thermal absorbability and then absorbs the heat efficiently. The temperature-increased or "hot" material accordingly transfers thermal energy to the object by heat conduction mechanisms. As a result, the object is capable of improving its own thermal absorbability by use of the radiant material as coated on its surface.

FIG. 1 depicts one embodiment of a speaker device of the instant invention having a radiant layer 14 formed on the surface of the voice coil 2. Otherwise, the voice coil and speaker arrangement of FIG. 1 is similar to the arrangement shown in FIG. 7. The related art voice coil 2 of FIG. 7 remains low in emissivity and thus has less thermal radiation based on infrared light. Accordingly, the coil arrangement has been designed so that nearly all of its generated heat is released for cooling purposes to the outside of the speaker device by means of air-flow conduction. However, this air-flow conduction of the prior art arrangement remains low in heat conduction rate or speed and thus is inferior in cooling efficiency because of the fact that heat conduction is accomplished by use of kinetic energies of molecules in gases.

Figure 7:
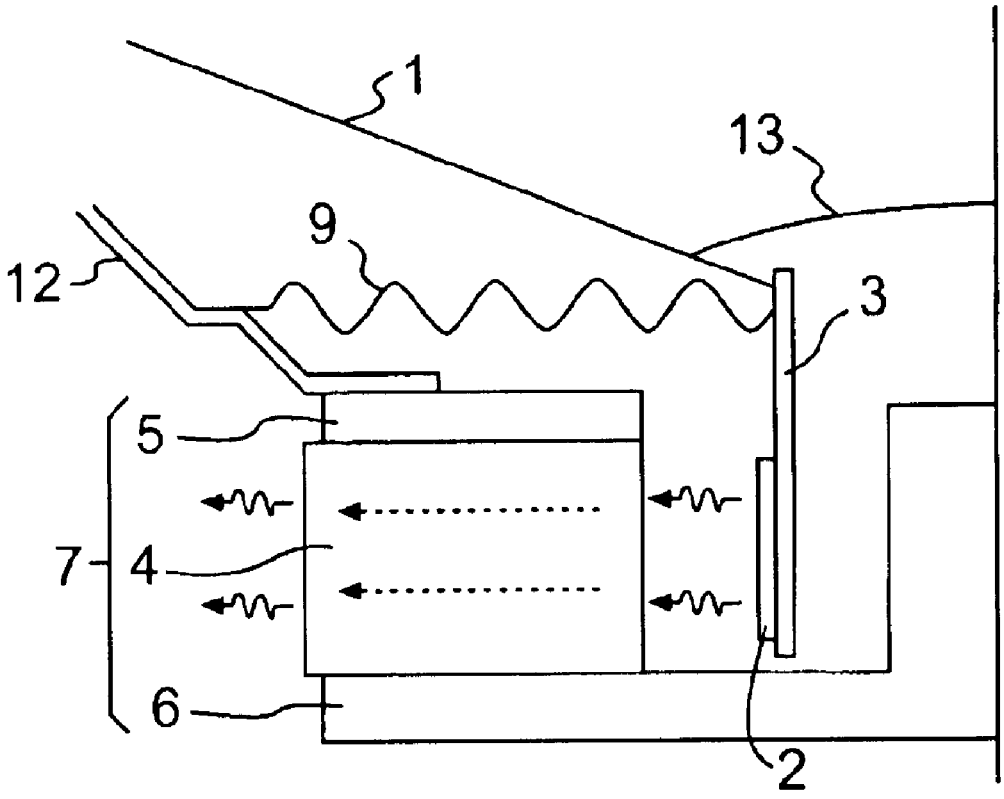
FIG. 7 illustrates an exemplary related art electrically-driven cone-shaped speaker unit having a voice coil along with its associated components.

To avoid this problem of the prior art arrangement of FIG. 7, a radiant layer 14 is formed on the surface of the voice coil 2 as shown in FIG. 1. This increases the emissivity of the voice coil 2 and accelerates heat releasability based on radiation of infrared light. This permits the heat-generated "hot" voice coil 2 to transmit its heat by thermal conduction toward the radiant layer, 14 on the surface thereof, thus allowing the temperature-increased radiant layer 14 to convert such heat to infrared light at its high emissivity for external heat radiation or escape.

In other words the voice coil 2 is capable of improving its own heat conduction efficiency through enhanced heat releasability by employing thermal radiation using infrared light in addition to the air-flow heat conduction schemes as traditionally employed.

Assume here that the radiant layer 14 is formed on the surface of the voice coil 2 which measures 0.1 in self emissivity, for example. If one further supposes that the emissivity of the radiant layer 14 is 0.9, for example, it becomes possible for the voice coil 2 to release or allow its generated heat to escape from the device due to drive power towards the outside of the device through conversion to infrared light at an increased emissivity that is nearly nine times greater than that in cases where such radiant layer 14 is absent. This in turn makes it possible to greatly enhance the radiational cooling of the voice coil 2. This results in an increase in input durability of a speaker unit concerned.

FIG. 2 shows another example of a speaker device of the instant invention with a further radiant layer 14, in addition to the layer described in FIG. 1, being formed on an internal surface of a cylinder of the voice coil bobbin 3 of the FIG. 7 arrangement. This example is such that the voice coil 2 is directly wound around an external cylinder surface of the voice coil bobbin 3, which causes the voice coil bobbin 3 to receive the most significant amount of thermal energy from the voice coil 2. The radiant layer 14 is then formed on the internal cylinder surface of the voice coil bobbin 3 to improve the emissivity of the voice coil bobbin 3 thus forcing the thermal energy transferred from the voice coil 2 to be converted to infrared light for outward release, which in turn enables further enhancement of cooling effects of the voice coil 2.

Turning now to FIG. 3, there is illustrated an example of another embodiment of the speaker device of the instant invention having a radiant layer 14 formed on an inner surface of a gap of the magnetic circuit 7 in FIG. 7, in addition to the radiant layer shown and described with regard to FIG. 1. This illustrative embodiment is similar to the one shown and described with regard to in FIG. 1 in that heat generated by the voice coil 2 is efficiently radiated in an outward direction by way of a conversion to infrared light in the manner described above. Accordingly, we refer to the above description of this process for the corresponding structure in FIG. 3. A detailed explanation of the additional radiant layer 14 formed on the inner surface of the gap of magnetic circuit 7, as shown in FIG. 3, is set forth in the following description.

As illustrated in FIG. 3, the voice coil 2 of the speaker device arrangement is arranged so that it is disposed within a recess or "gap" of almost a U-shaped cross-section of the magnetic circuit 7 portion surrounded thereby. Accordingly, nearly all rays of infrared light emitted from the radiant layer 14 of the voice coil 2 will be released towards the area of the inner surfaces of the gap of magnetic circuit 7 portion. However, an ordinary magnetic circuit 7 in a prior art speaker device arrangement absorbs only a small amount of infrared light. As a result, the prior art speaker device arrangement suffers from a lack of efficient absorption of heat that is generated by the voice coil 2 by the magnetic circuit 7. This situation results in the increased risk that the infrared rays that the magnetic circuit 7 fails to absorb will possibly return to the voice coil 2 by reflection.

To avoid this problem, the radiant layer 14 is formed on the inner gap surface of the magnetic circuit 7 as shown in FIG. 3 to increase the infrared absorbability at such gap internal surface thereby permitting the magnetic circuit 7 to efficiently absorb infrared rays given off from the voice coil 2 for achievement of reduction of reflection components of infrared light, which in turn results in the voice coil 2's generated heat being transferred towards the magnetic circuit 7 with increased efficiency.

In other words, by allowing the form of heat conduction from the voice coil 2 change from heat absorption due to air-flow conduction schemes with less thermal conduction efficiency to the heat absorption using infrared light that is high in conduction efficiency, it is possible for any generated heat from the voice coil 2 to be absorbed by the magnetic circuit 7 while at the same time permitting such absorbed heat to escape to the outside of the speaker device through the magnetic circuit 7. This in turn permits further improvement of the cooling effects of the voice coil 2, thus improving the input durability of the speaker.

Referring next to FIG. 4, a speaker device embodiment is illustrated which includes a radiant layer 14 on the external peripheral surface of the magnetic circuit 7 in addition to the radiant layer shown and discussed with regard to FIG. 1. The embodiment of FIG. 4 is similar to that shown in FIG. 1 in that heat generated by the voice coil 2 is efficiently radiated outwardly through conversion to infrared light in the way explained in the foregoing description because of the radiant layer situated on the voice coil 2. A detailed explanation of the radiant layer 14 formed on the outer peripheral surface of the magnetic circuit 7 will be set forth below.

In the prior art arrangement discussed above, the magnetic circuit 7 that has transmitted the heat generated by the voice coil 2 has a lower emissivity than in the arrangement of the instant invention. Therefore, it has been designed to employ air-flow conduction schemes for heat radiation rather than the infrared light-based heat release schemes of the instant invention. The arrangement of the instant invention shown in FIG. 4 contemplates that by forming the radiant layer 14 on the outer peripheral surface of the magnetic circuit 7, it is possible to advantageously increase the emissivity at the outer external periphery of the magnetic circuit 7 to thereby accelerate the release of heat from the speaker unit using infrared light. This in turn makes it possible to permit the heat sent to the magnetic circuit 7 to efficiently escape towards the outside of the speaker device. In other words, the magnetic circuit 7 of the instant invention is capable of improving the cooling effects of the speaker device by employing the airflow heat release schemes in combination with the infrared light-based heat release mechanisms. As a result, the heat generated and emitted from voice coil 2 increases in outward escapement via the magnetic circuit 7, thus improving the input durability of the speaker.

FIG. 5 illustrates an embodiment of the speaker device of the instant invention employing multiple radiant layers 14 in addition to the layer shown and described with regard to FIG. 1. The additional layers in FIG. 5 are formed on the inner surface of the magnetic gap, the voice coil bobbin, and the outer external peripheral surface of the magnetic circuit 7. As the technical effect and advantage of each layer has been explained by the foregoing discussion, a duplicative explanation thereof is not deemed necessary.

The speaker arrangement of FIG. 5 is designed to form the radiant layer 14 in the route along which the heat generated and transmitted from the voice coil 2 has been traditionally released to outside of the speaker while employing as its main heat conduction media infrared light rather than the air, thus improving the thermal conduction efficiency to thereby enhance the cooling effects of the voice coil 2, and accordingly of the entire speaker device arrangement.

More specifically, the voice coil 2's radiant layer 14 functions to convert heat generated by and transmitted from the voice coil 2 into corresponding infrared light for outward release. The additional radiant layer 14 within the gap of the magnetic circuit 7 then converts the infrared light given off from the voice coil 2 to heat for absorption. Next, the further radiant layer 14 on the outer peripheral surface of the magnetic circuit 7 converts the voice coil 2's heat as absorbed by the magnetic circuit 7 to infrared light rays for release toward the outside of the speaker. In this way, heat generated by the voice coil 2 is released out of it by infrared light transmission, having a high heat conduction efficiency, as well as by air transmission, having a low heat conduction efficiency. Accordingly, the resultant cooling effects of the voice coil 2 noticeably increases to likewise increase the input durability of the speaker.

It should be noted that while the above-described embodiments teach that the radiant layer or layers 14 is/are formed at the voice coil 2, voice coil bobbin 3 and/or magnetic circuit 7, the invention should not be limited only to such arrangements and may be modified so that more than one radiant layer 14 is formed at any other locations within the speaker device structure in order to enhance the cooling effects of the voice coil 2 and/or other speaker device components used.

The present invention has been described as being capable of increasing or maximizing the heat conduction rate of the voice coil 2 by principally changing the voice coil 2's heat release from the air transmission-based heat release schemes to infrared light-based heat radiation schemes using one or more radiant layers 14. This in turn makes it possible to suppress heat generation at the voice coil while simultaneously improving the input durability of the speaker unit itself. Another advantage of the instant invention is that its unique features are achievable by mere formation of the radiant layer 14 at the voice coil 2, for example, which minimizes limitations that would otherwise result from structural alteration of the speaker device and/or constituent parts selection criteria otherwise required in the related art. Accordingly, this permits accomplishment of the intended system design with increased flexibilities while retaining maximized compatibilities to the related art device structures.

The above-described invention accordingly results in an improvement of the heat release efficiency of a speaker unit voice coil to thereby enhance input durability of a speaker unit employing the coil. A speaker unit device is provided which includes one or more heat releasable or radiant layers formed at particular portions of the speaker device. These radiant layers permit the speaker device to no longer rely exclusively upon air flow to release heat generated from the voice coil towards the outside of the speaker unit, but is able to increase the amount of heat release by combining the air flow heat release with heat release resulting from the conversion of voice coil generated heat into infrared rays for external radiation. Accordingly, the resultant thermal transmission rate is improved to accelerate the cooling effects of the voice coil, which in turn enables enhancement of the input durability of the speaker device.

It will be apparent to those skilled in the art that various modifications and variations can be made in the receiver of the present invention without departing from the spirit or scope of the invention. Thus, it is intended that the present invention cover the modifications and variations of this invention provided they come within the scope of the appended claims and their equivalents.

What is claimed is:

1. A speaker device comprising:

a voice coil;

a first radiant layer made of radiant energy emissive material provided on a surface of the voice coil, wherein an emissivity of the first radiant emissive material is higher than an emissivity of the surface of the voice coil;

magnetic circuitry, wherein the voice coil is disposed within an air filled gap of the magnetic circuitry;

a voice coil bobbin coupled to the voice coil; and a second radiant layer made of radiant energy emissive material provided on a surface of the voice coil bobbin, wherein an emissivity of the second radiant emissive material is higher than an emissivity of the surface of the voice coil bobbin.

2. A speaker device comprising:

a voice coil;

a first radiant layer made of radiant energy emissive material provided on a surface of the voice coil, wherein an emissivity of the first radiant emissive material is higher than an emissivity of the surface of the voice coil;

magnetic circuitry, wherein the voice coil is disposed within an air filled gap of the magnetic circuitry; and a second radiant layer made of radiant energy emissive material provided within the air filled gap of the magnetic circuitry on a surface of the magnetic circuitry internal to the speaker device, wherein an infrared absorbability of the second radiant layer is higher than that of the surface of the magnetic circuitry.

3. A speaker device comprising:

a voice coil;

a first radiant layer made of radiant energy emissive material provided on a surface of the voice coil, wherein an emissivity of the first radiant emissive material is higher than an emissivity of the surface of the voice coil;

external magnetic circuitry, including a magnet, a plate, and a pole yoke, wherein the voice coil is disposed within an air filled gap of the magnetic circuitry; and a second radiant layer made of a radiant energy emissive material provided on at least an external surface of the magnet not within the air filled gap of the magnetic circuitry, wherein an emissivity of the second radiant layer is higher than an emissivity of the external surface of the magnetic circuitry.

4. The speaker device as claimed in claim 2, further comprising:

a third radiant layer made of a radiant energy emissive material provided on an external surface of the magnetic circuitry not within the air filled gap of the magnetic circuitry, wherein an emissivity of the third radiant emissive material is higher than an emissivity of the external surface of the magnetic circuitry.

5. The speaker device as claimed in claim 1, further comprising:

a third radiant layer made of radiant energy emissive material provided within the air filled gap of the magnetic circuitry on a surface of the magnetic circuitry internal to the speaker device, wherein an infrared absorbability of the third radiant layer is higher than that of the surface of the magnetic circuitry.

6. The speaker device as claimed in claim 1, further comprising:

a third radiant layer made of a radiant energy emissive material provided on an external surface of the magnetic circuitry not within the gap of the magnetic circuitry, wherein an emissivity of the third radiant emissive material is higher than an emissivity of the external surface of the magnetic circuitry.

7. The speaker device as claimed in claim 5, further comprising:

a fourth radiant layer made of a radiant energy emissive material provided on an external surface of the magnetic circuitry not within the gap of the magnetic circuitry, wherein an emissivity of the fourth radiant emissive material is higher than an emissivity of the external surface of the magnetic circuitry.

* * * * *